United States Patent [19]

Lindert

[11] 4,376,000

[45] Mar. 8, 1983

[54] COMPOSITION FOR AND METHOD OF AFTER-TREATMENT OF PHOSPHATIZED METAL SURFACES

[75] Inventor: Andreas Lindert, Troy, Mich.

[73] Assignee: Occidental Chemical Corporation, Warren, Mich.

[21] Appl. No.: 210,910

[22] Filed: Nov. 28, 1980

[51] Int. Cl.[3] ..... C23F 7/08

[52] U.S. Cl. ..... 148/6.15 R; 106/14.11

[58] Field of Search ..... 148/6.15 R, 6.15 Z, 148/6.2, 6.14 A; 106/14.11

[56] References Cited

U.S. PATENT DOCUMENTS 3,573,997 4/1971 Plaxton ..... 148/6.16

*Primary Examiner*—Sam Silverberg

*Attorney, Agent, or Firm*—Richard P. Mueller

[57] ABSTRACT

A process of post-treating a conversion-coated metal surface by contacting the surface with a dilute solution of a post-treatment compound, or a metal salt thereof, where the post-treatment compound is poly-4-vinylphenol or the reaction product of an aldehyde or ketone and poly-4-vinylphenol.

12 Claims, No Drawings

COMPOSITION FOR AND METHOD OF AFTER-TREATMENT OF PHOSPHATIZED METAL SURFACES

BACKGROUND OF THE INVENTION

The present invention relates to the art of metal surface treatment. More specifically, the present invention relates to the art of post-treating a conversion coated metal surface to impart improved corrosion resistance and paint adhesion characteristics thereto.

The need for applying protective coatings to metal surfaces for improved corrosion resistance and paint adhesion characteristics is well known in the metal finishing and other metal arts. The usual technique for applying such protective coatings to metal surfaces involves contacting the metal surface with a solution containing phosphate ions to form a corrosion resistant, nonreactive phosphate complex coating on the metal surface. Such coatings convert the metal surface from a chemically active surface readily susceptible to oxidation and are known in the art as "conversion coatings."

The corrosion-resistance of conversion coatings can be enhanced by treating the phosphatized metal surface with an after-treatment solution such as a dilute aqueous acidic solution containing a hexavalent chromium compound. However, although chromium after-treatment solutions and processes are known to be effective, in recent years there has been development effort directed to discovering effective alternatives to the use of chromium-containing post-treatments for conversion coatings.

In accordance with the present invention a composition which is alternative to hexavalent chromium compound containing solutions is provided for use in a novel process for the post-treatment of phosphatized or conversion coated metal surfaces. The solution and post-treatment process of the present invention are effective to enhance the corrosion resistance and paint adhesion characteristics of a conversion coated metal surface. Further understanding of this invention will be had from the following disclosure wherein all percentages are by weight unless otherwise indicated.

SUMMARY OF THE INVENTION

In accordance with the present invention, a composition which is well adapted for contacting a conversion coated metal surface as a post-treatment solution comprises a post-treatment compound selected from compounds and metal salts thereof having the general formula:

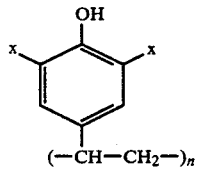

wherein n is from about 5 to about 100;

each x is independently selected from H or $CRR_1OH$; and each of R and $R_1$ is independently selected from aliphatic or aromatic organic moieties having from 1 to 12 carbon atoms.

Preferably, at least one x is $CH_2OH$, such as is obtained from the reaction product of poly-4-vinylphenol and formaldehyde. The present invention includes the post-treatment method of contacting a conversion coated metal surface with a solution of the present invention to enhance the corrosion resistance and paint adhesion characteristics of the conversion coated metal surface.

DETAILED DESCRIPTION OF THE INVENTION

Processes and solutions for forming conversion coatings on metal surfaces are well known and have been described, for example, in Metal Handbook, Volume II, 8th Edition, pages 529–547 of the American Society for Metals and in Metal Finishing Guidebook and Directory, pages 590–603 (1972), the contents of both of which are specifically incorporated herein by reference.

Typically, a conversion coating involves the following steps:

1. Cleaning;
2. Water rinsing;
3. Formation of the conversion coating by contact with a suitable phosphate, chromate, or similar conventional bath;
4. Water rinsing;
5. Applying a post-treatment solution; and
6. Optionally, drying the surface.

The present invention concerns the step of applying a post-treatment solution. Thus, the present invention provides a post-treatment composition which is well adapted, when in dilute solution form, for use in a process wherein a conversion coated metal surface is contacted therewith to improve the corrosion resistance and paint adhesion characteristics of the surface. The present invention is useful with a broad range of types of conversion coated metal surfaces. Examples of metals having surfaces which can be conversion coated with suitable conversion coating compositions include zinc, iron, aluminum and cold-rolled, ground, pickled, and hot-rolled steel and galvanized steel. Examples of conversion coating solutions include solutions comprising iron phosphate, magnesium phosphate, zinc phosphate, and zinc phosphate modified with calcium or magnesium ions.

In a typical metal treatment operation employing a composition and process of this invention, the metal to be treated is initially cleaned by a chemical or physical process to remove grease and dirt from the surface. Following this cleaning process, a conversion coating solution is applied in a conventional manner. The conversion coated surface is then rinsed and the post-treatment solution of the present invention is immediately applied.

The post-treatment composition of the present invention is a solution of a post-treatment compound, or a metal salt thereof, having the general formula:

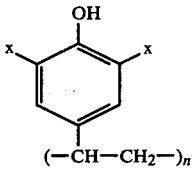

wherein n is from about 5 to about 100;

each x is independently selected from H or $CRR_1OH$; and each of R and $R_1$ is independently selected from aliphatic or aromatic organic moieties having from 1 to 12 carbon atoms.

It will, of course, be appreciated that the post-treatment compound of the present invention is poly-4-vinylphenol or a derivative thereof. It will be further appreciated that the terminal end groups of the poly-4-vinylphenol or derivative thereof can be hydrogen or other moiety depending upon the particular initiator employed in polymerizing the polymer. A derivative of poly-4-vinylphenol within the scope of the above general formula can be made by reacting poly-4-vinylphenol with a suitable aldehyde or ketone. For example, a poly-4-vinylphenol-formaldehyde derivative, wherein x is $CH_2OH$, can be made by dissolving poly-4-vinylphenol in ethanol at 70% solids, neutralizing 20% of the phenolic moieties with sodium hydroxide, then diluting the solution with water and reacting with formaldehyde for six hours at 60° C. Formaldehyde and poly-4-vinylphenol can be reacted in a 1:1 or other molar ratio although at ratios above 1:1 the reaction solution becomes so viscous as to react with difficulty.

The poly-4-vinylphenol and derivatives thereof are soluble in organic solvents and can be used as a post-treatment when dissolved in an organic solvent as, for example, ethanol. It is preferable, however, to apply the post-treatment compound from a water solution and poly-4-vinylphenol and derivatives thereof can be made water soluble by neutralizing 15–100% of the phenolic groups with a metal hydroxide such as sodium or potassium hydroxide to provide a metal salt. It is contemplated that the poly-4-vinylphenol or derivative or salt will be used in the post-treatment step in a working solution at a dilute concentration of, for example, from about 0.01% to about 5% by weight. Practically speaking, a concentration of 0.1% to 1% is preferred in the working solution. However, under some circumstances, for example, for transporting or storing the solution, a concentrate of the solution may be preferred. Thus, a solution comprising up to 30% of the treatment compound might be provided. From a commercial point of view, a suitable concentrate of this invention comprises from about 5% to about 30% of the post-treatment compound. To avoid precipitation of the treatment compound, the pH of the solution, whether concentrate or dilute working solution should be at least about 8. Generally, a pH within the range of from about 8 to about 12 is suitable.

Application of the post-treatment solution of the present invention in the post-treatment step to a metal surface can be carried out by any conventional method. For example, the post-treatment solution can be applied by spray coating, roller coating, or dipping. The temperature of the solution applied can vary over a wide range, but is preferably from 70° F. to 160° F. After application of the post-treatment solution to the metal surface, the surface can optionally be rinsed, although good results can be obtained without rinsing after post-treatment. For some end uses, however, rinsing may be preferred.

Next, the post-treated metal surface is dried. Drying can be carried out by, for example, circulating air or oven drying. While room temperature drying can be employed, it is preferable to use elevated temperatures to decrease the amount of drying time required.

After drying, the conversion coated and post-treated metal surface is then ready for painting or the like. The surface is suitable for standard paint or other coating application techniques such as brush painting, spray painting, electro-static coating, dip, roller coating, as well as electrocoating. As a result of the post-treatment step of the present invention, the conversion coated surface has improved paint adhesion and corrosion resistance characteristics.

Further understanding of the present invention can be had from the following examples in which several panels were treated and tested. The following procedures were used for each panel.

Each panel comprised cold rolled steel and was first cleaned with a strong alkaline cleaner followed by thorough rinsing with hot water. An iron phosphate conversion coating (Bonderite *1000 made by Parker Co.) was applied to the clean panel surface at 140°–160° F. by spray application to form a conversion coating thereon followed by rinsing with cold water. Then the post-treatment or other solution of the particular example below was immediately applied to the conversion coated surface at 140° F. to 160° F. The treated panel was then rinsed with deionized water and baked in a 350° F. oven for 5 minutes. Each panel was then painted with a thermosetting baking enamel.

Salt spray corrosion resistance was measured in accordance with ASTMB117-61. The paint was scribed from corner to corner with an "X", using a sharp knife scribing all the way to the bare metal. Then the panel was placed in a salt spray cabinet containing a 5% aerated sodium chloride solution at 95° F. Each panel was placed above the solution and the salt solution was continuously misted into the air by a spray nozzle. The panels were tested in salt spray for 504 hours. As is set forth below, each panel was rated in terms of the amount of paint loss from the scribe in 1/16 inch increments (N for no loss of paint at any point). The numbers represent the general range of the creepage from the scribe along its length in inches. Thus, 0-1 represents creepage varied from 0 to 1/16 inches.

Humidity corrosion resistance was measured in accordance with the procedure of ASTM 2247-64T. As set forth below, the panels were rated in terms of the number size of blisters: from 9 for a very small size to 1 for very large. Ten represents no blisters.

EXAMPLES

| Example | Post-Treatment | Concentration | 504 Hours Salt Spray | Humidity Resistance |
|---|---|---|---|---|
| 1. | Parcolene 60 Chromate Control | — | N | 10 |
| 2. | Dionized Water | | (264 hrs.) Failure | Failure |
| 3. | Poly-4-vinylphenol formaldehyde sodium salt 20% neutralized 1:1 phenolformaldehyde ratio | .35% | N | 10 |
| 4. | Poly-4-vinylphenol formaldehyde sodium salt 20% neutralized 1:1 phenolformaldehyde ratio | .1% | N | 10 |
| 5. | Poly-4-vinylphenol formaldehyde sodium salt 20% neutralized 1:1 phenolformaldehyde ratio | .05% | N | 10 |
| 6. | Poly-4-vinylphenol in Ethanol | 1% | 0–1 | 10 |
| 7. | Poly-4-vinylphenol | .1% | 0–1 | 10 |

-continued

| Example | Post-Treatment | Concentration | 504 Hours Salt Spray | Humidity Resistance |
|---|---|---|---|---|
| | in Ethanol | | | |
| 8. | Poly-4-vinylphenol in Ethanol | .05% | 0–2 | 10 |

The results of the above examples show that after-treatment of a phosphatized metal surface in accordance with the present invention provides good salt spray and humidity resistance to the material.

What is claimed is:

1. In a process of post-treating a phosphate-type conversion coated metal surface, the improvement comprising contacting said surface with a post-treatment compound selected from the group consisting of compounds and salts thereof having the following general formula:

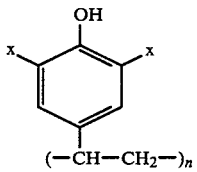

wherein n is from about 5 to about 100;

each x is independently selected from H or $CRR_1OH$; and each of R and $R_1$ is independently selected from aliphatic or aromatic organic moieties having from 1 to 12 carbon atoms.

2. The process of claim 1 wherein at least one x is $CH_2OH$.

3. The process of claim 1 wherein said post-treatment compound is the reaction product of poly-4-vinylphenol and formaldehyde.

4. The process of claim 1 wherein said post-treatment compound is a metal salt and is in solution in an aqueous medium.

5. The process of claim 4 wherein at least one x is $CH_2OH$.

6. The process of claim 4 wherein said metal salt is present in said solution in a concentration of from about 0.01% to about 5% by weight.

7. The process of claim 4 wherein said metal salt is present in said solution in a concentration of from about 0.1% to about 1% by weight.

8. The process of claim 1 wherein said post-treatment compound is poly-4-vinylphenol.

9. The process of claim 8 wherein said metal surface is contacted with an organic solution comprising said poly-4-vinylphenol.

10. The process of claim 1 wherein said post-treatment compound is a salt of poly-4-vinylphenol.

11. The process of claim 1 wherein said post-treatment compound is a reaction product of poly-4-vinylphenol and an aldehyde.

12. The process of claim 1 wherein said post-treatment compound is a reaction product of poly-4-vinylphenol and a ketone.

* * * * *